US009648993B2

(12) United States Patent
Gainey

(10) Patent No.: US 9,648,993 B2
(45) Date of Patent: May 16, 2017

(54) TOWEL AND WASHCLOTH HOLDING DEVICE

(71) Applicant: Nathaniel Gainey, Graham, NC (US)

(72) Inventor: Nathaniel Gainey, Graham, NC (US)

( * ) Notice: Subject to any disclaimer, the term of this patent is extended or adjusted under 35 U.S.C. 154(b) by 0 days.

(21) Appl. No.: 14/862,271

(22) Filed: Sep. 23, 2015

(65) Prior Publication Data

US 2016/0113449 A1 Apr. 28, 2016

Related U.S. Application Data

(60) Provisional application No. 62/067,540, filed on Oct. 23, 2014.

(51) Int. Cl.

| | |
|---|---|
| ***A47K 10/04*** | (2006.01) |
| ***F16M 13/02*** | (2006.01) |
| *A47F 5/08* | (2006.01) |
| *A47F 7/00* | (2006.01) |
| *A47K 10/10* | (2006.01) |

(52) U.S. Cl.

CPC ..... *A47K 10/04* (2013.01); *F16M 13/02* (2013.01); *A47F 5/08* (2013.01); *A47F 7/0021* (2013.01); *A47K 10/10* (2013.01)

(58) Field of Classification Search

CPC ..... A47K 10/04; A47K 10/10; A47K 10/22; F16L 3/227; F16L 3/23; F16L 3/237

USPC .... 211/16, 60.1, 64–66, 85.18, 88.04, 89.01, 211/119.009, 87.01; D6/315, 320, 325, D6/678, 682, 682.1, 512–513, 524, 546; 206/581; 248/176.1, 127, 68.1, 69, 315, 248/62, 49, 74.1

See application file for complete search history.

(56) References Cited

U.S. PATENT DOCUMENTS

| | | | | | |
|---|---|---|---|---|---|
| 170,288 | A * | 11/1875 | Miller | A47B 41/00 | 211/124 |
| 323,773 | A * | 8/1885 | Badger | A47G 25/10 | 211/32 |
| 328,926 | A * | 10/1885 | Elliott | A47G 7/044 | 211/104 |
| 376,480 | A * | 1/1888 | Kenway | F16L 3/14 | 248/59 |
| 386,939 | A * | 7/1888 | Sterling | A47F 5/01 | 211/106 |
| 429,357 | A * | 6/1890 | McBee | F16L 3/2235 | 24/135 R |

(Continued)

*Primary Examiner* — Joshua J Michener
*Assistant Examiner* — Devin Barnett
(74) *Attorney, Agent, or Firm* — Global Intellectual Property Agency, LLC; Daniel Boudwin

(57) ABSTRACT

A towel holding device for storing a towel and a washcloth in a rolled configuration. The holding device includes a bracket having a first section rigidly affixed to a second section, wherein the first and second sections are preferably perpendicular to one another. The bracket includes a first ring thereon, wherein the first ring includes an open central area sized to receive a rolled towel therein. The bracket further includes a second ring, wherein the second ring includes an open central area sized to receive a rolled washcloth therein. Thus, the first ring preferably comprises a larger diameter than the second ring. Further, the first and second rings are positioned adjacent to one another on the bracket. The bracket can be affixed to a support surface, such as a wall, using any conventional fasteners, such as screws, or nails, among others.

4 Claims, 3 Drawing Sheets

(56) References Cited

U.S. PATENT DOCUMENTS 435,133 A * 8/1890 Campbell ..... A47K 10/04 16/87.2
508,914 A * 11/1893 Cain ..... F16L 3/14 248/62
545,561 A * 9/1895 Weeden ..... F16L 3/2235 248/68.1
555,913 A * 3/1896 Hodgdon ..... F16L 3/2235 248/68.1
D26,928 S * 4/1897 Glock ..... D6/532
591,249 A * 10/1897 Emery ..... F16L 3/14 191/40
655,739 A * 8/1900 Runtz ..... A45C 13/02 206/293
746,269 A * 12/1903 Beaton ..... F16L 3/2235 248/68.1
755,847 A * 3/1904 Clarkson ..... F16L 3/2235 248/295.11
771,905 A 10/1904 Germain
791,912 A * 6/1905 Jackson ..... 206/459.5
799,092 A * 9/1905 Rosenfeld ..... F16L 3/2235 211/60.1
970,485 A * 9/1910 Frey ..... A47K 5/02 211/85.12
973,173 A * 10/1910 Comeau ..... A47G 25/10 211/30
1,001,416 A * 8/1911 Lloyd ..... A47B 73/00 211/181.1
1,010,589 A * 12/1911 Clark ..... E01B 3/16 238/286
1,116,209 A * 11/1914 Barber ..... A47K 10/10 211/16
1,136,331 A * 4/1915 Harding ..... A47F 5/01 211/106
1,159,821 A * 11/1915 Barger ..... A47F 5/01 248/315
1,193,024 A * 8/1916 Kennedy ..... A63B 63/083 248/315
1,248,760 A * 12/1917 Wallin ..... A47G 25/746 211/120
1,262,763 A * 4/1918 Farley ..... F16L 3/14 248/62
1,381,227 A * 6/1921 Pleister ..... F16L 3/06 248/69
1,381,233 A * 6/1921 Pleister ..... F16L 3/06 248/69
1,419,932 A * 6/1922 Karitzky ..... F16L 3/06 248/69
1,508,320 A * 9/1924 Heide ..... F16L 3/24 248/68.1
1,590,052 A * 6/1926 Nikola ..... A47H 19/00 160/108
1,625,897 A * 4/1927 Klein ..... F16L 3/06 248/69
1,634,777 A * 7/1927 Girdler ..... B65F 1/141 206/352
1,646,068 A * 10/1927 Rosner ..... A47K 10/14 211/16
1,700,168 A * 1/1929 Klein ..... F16L 3/06 248/69
1,742,243 A * 1/1930 Fish ..... F16L 3/06 248/69
1,975,303 A * 10/1934 Walker ..... G10G 5/00 248/125.1
2,222,831 A * 11/1940 Bitney ..... A62C 33/04 211/106
2,337,950 A * 12/1943 Werner et al. ..... A47H 13/00 160/330
2,407,217 A * 9/1946 Banneyer ..... F16L 3/00 248/68.1
2,413,772 A * 1/1947 Morehouse ..... F16L 3/1233 24/336
2,430,238 A * 11/1947 Moorefield ..... A47K 10/12 248/315
2,470,233 A * 5/1949 Boye ..... A47H 19/00 160/349.2
D160,484 S * 10/1950 DeMark ..... D6/529
2,527,151 A * 10/1950 Rabasse ..... A47K 10/14 248/316.7
2,534,690 A * 12/1950 Young, Jr. ..... F16L 3/227 248/68.1
2,576,873 A * 11/1951 Zelov ..... A47K 10/12 211/16
2,584,644 A * 2/1952 Verdi ..... A47L 13/512 211/105.1
2,596,835 A * 5/1952 Benge ..... A01K 87/04 24/567
2,815,792 A * 12/1957 Buchanan ..... B21D 53/36 72/476
2,839,202 A 6/1958 Arnett
2,863,203 A * 12/1958 Dalpiaz ..... F16L 3/23 24/279
2,893,675 A * 7/1959 Smith ..... A47G 23/0225 248/222.41
2,916,237 A * 12/1959 Bertling ..... H01B 17/24 174/162
2,943,745 A * 7/1960 Bjornson ..... G01K 1/083 211/60.1
2,964,274 A * 12/1960 Richardson ..... H02G 3/32 248/68.1
2,972,461 A * 2/1961 Balbach ..... F16L 3/23 248/68.1
2,990,066 A 6/1961 Arnett
3,023,891 A * 3/1962 Sutter ..... A47J 47/16 206/231
3,068,924 A * 12/1962 Summers ..... F16B 37/044 248/68.1
D194,528 S 2/1963 Arnett
3,095,042 A * 6/1963 Clark, Jr. ..... E21B 43/10 138/112
3,108,723 A * 10/1963 Hickey ..... A47G 25/10 211/30
D201,984 S * 8/1965 Hervey ..... D6/569
3,226,069 A * 12/1965 Clarke ..... F16L 3/227 24/282
3,262,663 A * 7/1966 Jansson ..... F16L 3/12 24/339
3,339,814 A * 9/1967 Carbine ..... B65D 23/104 206/145
D210,833 S * 4/1968 Cura ..... D6/320
3,429,535 A * 2/1969 Herzig ..... F16L 3/00 248/58
3,432,129 A * 3/1969 Santucci ..... F16L 3/237 24/343
3,457,389 A * 7/1969 Knapp ..... A47K 10/06 211/16
3,563,131 A * 2/1971 Ridley, Sr. ..... F16B 35/04 411/384
3,632,069 A * 1/1972 Thayer ..... H02G 3/32 248/56
3,643,811 A * 2/1972 Howerton ..... A47B 81/005 211/4
3,734,439 A * 5/1973 Wintz ..... A47G 23/0241 131/241
3,746,178 A * 7/1973 Wagschal ..... A47B 73/006 211/194
D228,858 S * 10/1973 Wagschal ..... D6/682.2
D230,242 S * 2/1974 Bentley ..... D6/682.2
3,881,314 A * 5/1975 Hennig ..... F16G 13/16 248/49
3,960,454 A * 6/1976 Schroeder ..... A63D 5/10 15/231
3,968,912 A * 7/1976 Horwitz ..... B62J 11/00 224/448
3,982,304 A * 9/1976 Menshen ..... F16L 3/237 248/68.1
3,995,742 A * 12/1976 Austin ..... A01K 97/08 16/225

(56) References Cited

U.S. PATENT DOCUMENTS 4,011,951 A * 3/1977 Boyer ..... A01K 5/01 119/51.5
4,018,411 A * 4/1977 Hennig ..... F16G 13/16 248/49
4,089,087 A * 5/1978 Heitman ..... F16L 3/2235 24/329
4,093,076 A * 6/1978 Newton ..... A47B 73/006 211/189
D248,803 S * 8/1978 Newton ..... D6/527
D248,909 S * 8/1978 Frazian ..... D12/420
D253,504 S * 11/1979 Grosfillex ..... D6/531
4,205,629 A * 6/1980 Wix ..... A01K 5/0114 119/51.5
D256,540 S * 8/1980 Conti ..... D23/400
D257,458 S * 10/1980 Benoit ..... D6/531
D257,947 S * 1/1981 Reynoso ..... 248/57
4,252,289 A * 2/1981 Herb ..... F16L 3/11 248/62
4,270,662 A * 6/1981 Gonzalez ..... A47B 73/006 211/186
D269,000 S * 5/1983 Girard ..... D12/115
4,398,692 A * 8/1983 Macfie ..... A47K 10/12 211/45
D272,699 S * 2/1984 Godfrey ..... 211/74
D277,149 S * 1/1985 Hind ..... D6/535
4,526,124 A * 7/1985 Hartwall ..... B63B 59/02 114/219
D281,950 S * 12/1985 Sachs ..... D8/370
D286,261 S * 10/1986 Smederod ..... 160/349.2
4,615,054 A * 10/1986 Buecheler ..... A47K 17/00 4/222
4,679,695 A * 7/1987 Leff ..... A47J 47/16 211/74
4,773,348 A * 9/1988 Rowley ..... E02B 3/26 114/219
4,844,399 A * 7/1989 Harm ..... A63B 55/60 224/274
D302,756 S * 8/1989 Trine ..... D30/133
D302,805 S * 8/1989 Hoyt ..... D12/115
4,875,592 A 10/1989 Waller
4,897,952 A * 2/1990 Hawie ..... A01K 97/08 211/60.1
4,925,136 A * 5/1990 Knott ..... F16L 3/133 248/62
4,934,650 A * 6/1990 LeKuch ..... F16L 55/035 248/60
5,035,383 A * 7/1991 Rainville ..... F16L 3/223 248/68.1
5,141,045 A * 8/1992 Williams ..... A47H 19/00 160/348
D329,562 S * 9/1992 McKeone ..... D6/527
D331,174 S * 11/1992 Polski ..... D7/621
5,186,427 A * 2/1993 Semchuck ..... A47K 10/04 248/224.7
5,188,319 A * 2/1993 Hawash ..... B60R 16/0215 248/68.1
5,209,382 A * 5/1993 Chang ..... A47G 25/746 211/87.01
D339,977 S * 10/1993 Ferdman ..... D8/368
D340,824 S * 11/1993 Pujals, Jr. ..... D6/566
5,323,996 A * 6/1994 Rendall ..... A47K 10/04 248/205.3
5,335,799 A * 8/1994 Coudron ..... A47F 7/0021 211/65
5,339,966 A * 8/1994 Bastiaans ..... A47B 81/005 211/4
D357,401 S * 4/1995 Iverson ..... D12/115
D357,624 S * 4/1995 Ferdman ..... D8/368
5,402,978 A * 4/1995 Larson ..... A47K 10/3836 248/309.2
D357,838 S * 5/1995 Lehn ..... D6/546
D366,999 S * 2/1996 Ferdman ..... D8/368
5,547,152 A * 8/1996 Krock ..... F16L 3/1008 24/274 WB
5,580,020 A * 12/1996 Catchings ..... B63B 29/04 248/311.2
D379,296 S * 5/1997 Ferdman ..... D8/368
D379,570 S * 6/1997 Moon ..... D6/574
D379,920 S * 6/1997 Bozzo ..... D8/368
D386,363 S * 11/1997 Dardashti ..... D6/680.3
D387,233 S * 12/1997 Effron ..... D6/566
D387,933 S * 12/1997 Effron ..... D6/566
5,725,185 A * 3/1998 Auclair ..... F16L 3/12 248/73
5,740,927 A * 4/1998 Yemini ..... A47B 96/067 211/66
D395,412 S * 6/1998 Sullivan ..... D11/202
5,775,401 A * 7/1998 Faurie ..... A47H 19/00 160/349.2
D396,586 S * 8/1998 Warshawsky ..... D6/527
D397,568 S * 9/1998 Jonas ..... D6/546
D401,461 S * 11/1998 Laga ..... D6/566
D406,715 S * 3/1999 Badillo ..... D6/524
5,890,605 A * 4/1999 Percudani ..... A47B 67/00 211/119.009
5,896,892 A * 4/1999 Adamson ..... F16L 57/005 138/89
5,906,341 A * 5/1999 Brown ..... F16L 3/227 248/49
5,947,305 A * 9/1999 Lin ..... A47B 73/006 211/74
5,967,345 A * 10/1999 Subotin ..... A47C 7/62 211/119.007
5,971,329 A * 10/1999 Hickey ..... F16L 3/227 248/316.7
6,015,004 A * 1/2000 Harkinson ..... A47H 19/00 160/348
D419,816 S * 2/2000 Harkinson ..... D6/578
D421,160 S * 2/2000 Akopdjanov ..... D30/133
6,047,837 A * 4/2000 Kessens ..... B25H 3/04 211/181.1
6,050,104 A * 4/2000 Corona ..... F25D 31/007 220/592.01
D434,259 S * 11/2000 Gastelum ..... D6/546
D436,478 S * 1/2001 Mahlmann ..... D6/535
6,179,180 B1 * 1/2001 Walker ..... B62J 11/00 224/401
D439,783 S * 4/2001 Harkinson ..... D6/580
6,209,732 B1 * 4/2001 Dennis ..... A45D 1/04 211/70.6
D441,232 S * 5/2001 Wu ..... D6/524
6,298,525 B1 * 10/2001 Margo ..... F16L 3/237 24/336
D455,035 S * 4/2002 Meck ..... D6/548
D455,307 S * 4/2002 Hoernig ..... D6/532
D456,195 S * 4/2002 Meck ..... D6/549
6,364,257 B1 * 4/2002 Holder ..... F16L 3/2336 24/16 PB
6,422,400 B1 * 7/2002 Miller ..... A47F 7/06 211/183
6,422,401 B1 * 7/2002 Roten ..... A47F 7/06 211/32
6,435,565 B2 * 8/2002 Potts ..... F16L 3/237 24/16 R
6,464,182 B1 * 10/2002 Snyder ..... E04C 3/02 248/217.2
6,490,765 B2 * 12/2002 Anthes ..... F16L 33/04 24/279
D471,081 S * 3/2003 Wu ..... D8/356
6,547,112 B2 * 4/2003 Gallagher ..... B60R 11/00 224/401
6,644,612 B2 * 11/2003 Webb ..... A47G 23/0225 248/311.2
6,685,147 B1 * 2/2004 Ma ..... A45D 34/00 248/105
D494,399 S * 8/2004 Rodriguez ..... D6/567
6,805,247 B2 * 10/2004 Saez ..... B62H 3/00 211/17

(56) References Cited

U.S. PATENT DOCUMENTS 6,820,781 B1 * 11/2004 Gardner ..... B60R 9/00 224/401
6,840,411 B2 * 1/2005 Fritz ..... A47G 25/10 223/24
6,899,236 B2 * 5/2005 Yang ..... A47J 47/16 211/71.01
6,901,880 B2 * 6/2005 Hammer ..... A01K 5/0114 119/61.4
6,902,138 B2 * 6/2005 Vantouroux ..... F16L 3/1091 248/68.1
6,986,489 B2 * 1/2006 Oddsen, Jr. ..... F16M 11/24 211/64
7,047,771 B2 * 5/2006 Tanos ..... E05B 15/0046 211/64
7,093,808 B2 * 8/2006 Yuzuriha ..... F16L 33/03 24/20 R
D541,604 S * 5/2007 Goodman ..... D7/704
7,318,568 B2 * 1/2008 Barouta ..... B65D 33/001 206/554
D566,442 S * 4/2008 Rubin ..... D6/527
7,401,753 B2 * 7/2008 Bozmoski ..... F01N 13/1805 248/316.1
D605,093 S * 12/2009 Lohr ..... D12/115
D608,054 S * 1/2010 Radfar ..... D28/73
D620,734 S * 8/2010 Leffall ..... D6/535
7,967,173 B2 * 6/2011 Kopp ..... A42B 1/002 223/12
8,262,035 B2 * 9/2012 Bleus ..... F16L 3/1025 248/230.7
D673,378 S * 1/2013 Lewis ..... D6/315
D695,974 S * 12/2013 Young ..... D30/130
8,608,121 B2 * 12/2013 Maehara ..... G21C 13/032 248/231.31
D702,887 S * 4/2014 Petruccelli ..... D28/38
D703,381 S * 4/2014 Petruccelli ..... D28/38
8,708,289 B2 * 4/2014 Allenbach ..... F16L 3/2235 248/68.1
8,770,537 B2 * 7/2014 Go ..... E02F 9/2275 212/347
8,789,712 B2 * 7/2014 Johnson ..... A47F 5/0025 211/71.01
8,869,996 B1 * 10/2014 Christenson ..... A47F 7/0028 211/119.009
D722,438 S * 2/2015 Tsai ..... D6/315
D723,288 S * 3/2015 Goodman ..... D6/315
8,985,529 B2 * 3/2015 Masters ..... F16L 3/223 248/176.1
9,222,603 B2 * 12/2015 Rego ..... F16L 3/1211
D753,767 S * 4/2016 Blette ..... D19/104
9,320,355 B2 * 4/2016 Lee ..... A47B 73/006
D772,494 S * 11/2016 Wu ..... D30/133
D774,325 S * 12/2016 Belokin ..... D6/571
2001/0030267 A1 * 10/2001 Caveney ..... F16L 3/23 248/68.1
2003/0102412 A1 * 6/2003 Miescher ..... F16L 3/133 248/62
2004/0026576 A1 * 2/2004 Shibuya ..... F16L 3/11 248/62
2004/0084574 A1 * 5/2004 Goodwin ..... F16L 3/1233 248/63
2004/0149875 A1 * 8/2004 Reynolds ..... A45D 20/12 248/309.1
2005/0011842 A1 * 1/2005 Gideon ..... A47F 7/283 211/74
2005/0011843 A1 * 1/2005 Dagan ..... A47F 7/283 211/74
2005/0023233 A1 * 2/2005 Yang ..... A47J 47/16 211/71.01
2005/0082242 A1 * 4/2005 Hurst ..... A47B 73/00 211/71.01
2005/0109887 A1 * 5/2005 Catapano ..... H02G 3/30 248/68.1
2005/0173597 A1 * 8/2005 Farrell ..... F16L 3/22 248/68.1
2006/0027514 A1 * 2/2006 Carlson ..... A47B 43/00 211/72
2006/0289367 A1 * 12/2006 Cossey ..... A45D 44/06 211/13.1
2007/0045501 A1 * 3/2007 Chen ..... G02B 23/16 248/346.03
2007/0108144 A1 * 5/2007 Flick ..... C12H 1/22 211/74
2007/0210022 A1 * 9/2007 Bianchini ..... B25H 3/04 211/75
2007/0257157 A1 * 11/2007 Lu ..... F16L 3/221 248/68.1
2008/0245932 A1 * 10/2008 Prellwitz ..... B29C 70/22 248/49
2009/0045314 A1 * 2/2009 Lien ..... G09F 1/103 248/452
2009/0172876 A1 * 7/2009 Hendrickson ..... A47K 10/08 4/638
2009/0230256 A1 * 9/2009 Widlacki ..... F16L 3/222 248/68.1
2009/0308995 A1 * 12/2009 Kuo ..... A47K 10/10 248/231.91
2009/0321586 A1 * 12/2009 Kabat ..... F16L 3/23 248/49
2010/0213145 A1 * 8/2010 Swank ..... A47K 10/04 211/16
2011/0056896 A1 * 3/2011 Tzekova ..... A47K 10/14 211/45
2011/0121145 A1 * 5/2011 Mihajlovic ..... F21S 6/001 248/188
2013/0139375 A1 * 6/2013 Rego ..... F16L 3/23 29/525.11
2014/0027592 A1 * 1/2014 Kusiak ..... F16G 11/103 248/231.91
2014/0374552 A1 * 12/2014 Zhong ..... F16B 47/00 248/205.5
2015/0014505 A1 * 1/2015 Edwards ..... A47K 1/09 248/251
2015/0315954 A1 * 11/2015 Edemann ..... F01N 13/1805 285/420

* cited by examiner

TOWEL AND WASHCLOTH HOLDING DEVICE

CROSS REFERENCE TO RELATED APPLICATION

This application claims the benefit of U.S. Provisional Application No. 62/067,540 filed on Oct. 23, 2014. The above identified patent application is herein incorporated by reference in its entirety to provide continuity of disclosure.

BACKGROUND OF THE INVENTION

Field of the Invention

The present invention relates to holding devices for towels, washcloths, and other similar articles. More specifically, the present invention provides a holding device adapted for use in holding a towel and a washcloth, wherein the holding device comprises a bracket having a first ring for use in holding a towel and a second ring for use in holding a washcloth.

Towels and washcloths can be difficult to store in a neat and organized manner. Towels are often folded and stacked on top of one another so that they do not consume much space while being stored. However, stacking the towels may make it difficult to retrieve a towel from the stack, and there is risk that a person may knock over the stack of towels. Further, when a user prepares to take a bath or shower, the user needs a washcloth in addition to a towel. However, washcloths are generally stored separately from the towels, and there may not be enough washcloths for each towel. Thus, a device that facilitates storage of a towel and washcloth is desired.

Devices have been disclosed in the prior art that relate to towel and washcloth holding devices. These include devices that have been patented and published in patent application publications. These devices generally relate to towel and washcloth holding devices having a plurality of shelf members used to support towels and washcloths, such as U.S. Pat. No. 2,839,202, U.S. Pat. No. 2,990,066, U.S. Design Pat. No. D194,528, U.S. Pat. No. 4,875,592, and U.S. Pat. No. 771,905.

These prior art devices have several known drawbacks. While the devices in the prior art provide means for storing towels and/or washcloths, the prior art fails to disclose a device comprising a bracket that can be mounted to a support surface, wherein the bracket includes rings of different diameters thereon, wherein each ring is adapted to hold a towel or washcloth in a rolled configuration. Thus, the prior art devices do not allow a user to easily store a towel and washcloth together in an organized manner.

In light of the devices disclosed in the prior art, it is submitted that the present invention substantially diverges in design elements from the prior art and consequently it is clear that there is a need in the art for an improvement to existing towel holding devices. In this regard the instant invention substantially fulfills these needs.

SUMMARY OF THE INVENTION

In view of the foregoing disadvantages inherent in the known types of holding devices now present in the prior art, the present invention provides a new holding device for towels and washcloths wherein the same can be utilized for providing convenience for the user when storing a towel and washcloth in an organized and convenient manner.

It is therefore an object of the present invention to provide a new and improved holding device for towels and washcloths comprising an L-shaped bracket having a first ring for use in holding a towel and a second ring for use in holding a washcloth.

It is another object of the present invention to provide a holding device for towels and washcloths that can be mounted to a support surface, such as a wall or a door.

Another object of the present invention is to provide a holding device for towels and washcloths that is adapted to hold a towel and a washcloth in a rolled configuration for easy access.

Another object of the present invention is to provide a holding device for towels and washcloths that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
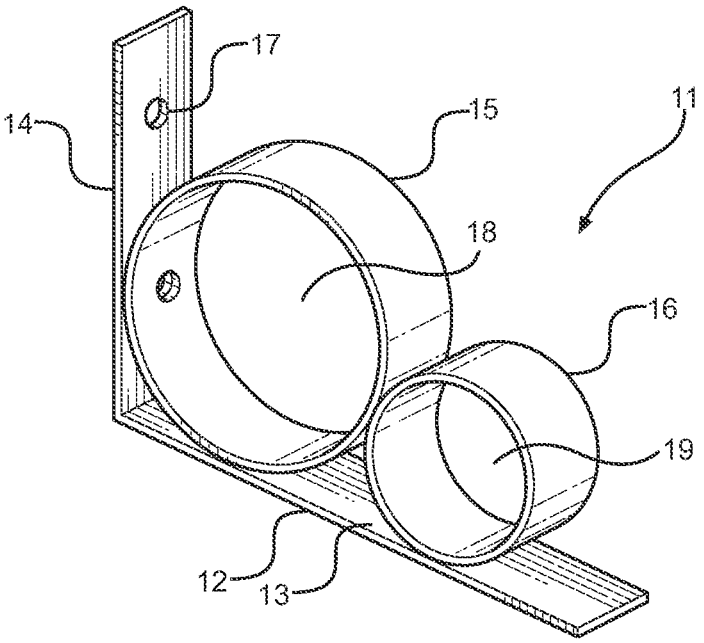
FIG. 1 shows a perspective view of an embodiment of the holding device.

Reference is made herein to the attached drawings. Like reference numerals are used throughout the drawings to depict like or similar elements of the holding device of the present invention. For the purposes of presenting a brief and clear description of the present invention, the preferred embodiment will be discussed as used for holding a towel and a washcloth in a rolled configuration for storage thereof. The figures are intended for representative purposes only and should not be considered to be limiting in any respect.

Figure 2:
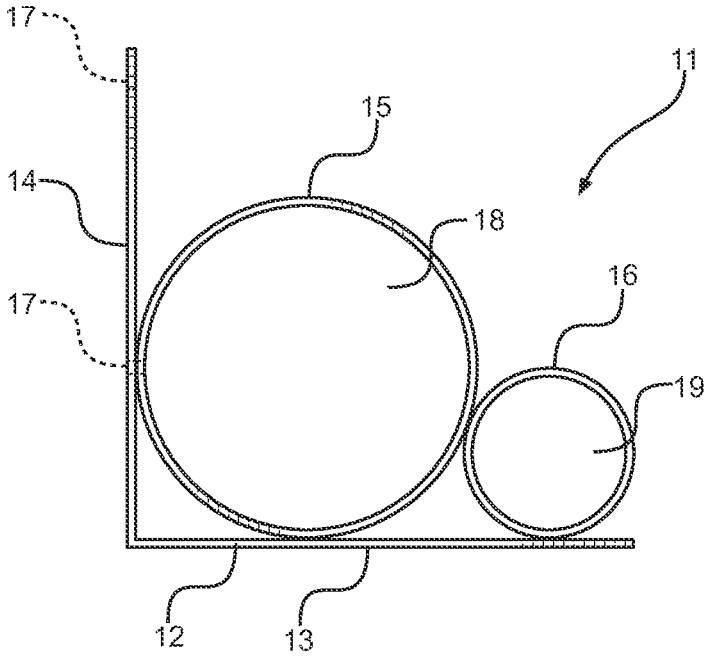
FIG. 2 shows a side view of an embodiment of the holding device.

Referring now to FIGS. 1 and 2, there are shown perspective and side views of an embodiment of the holding device, respectively. The holding device 11 comprises a bracket 12 having a first section 13 permanently affixed to a second section 14 so as to form an L-shape. Preferably, the first section 13 is positioned perpendicularly to the second section 14. The bracket 12 includes one or more apertures 17 therethrough, wherein the apertures 17 are adapted to receive a fastener in order to secure the bracket 12 to a support surface, such as a wall or door, among others. The bracket 12 is adapted to be secured to a support surface using any suitable fasteners, such as screws or nails.

The holding device 11 further comprises a first ring 15 thereon, wherein the first ring 15 is adapted to hold a towel in a rolled configuration. The ring 15 is positioned on the bracket 12 and is rigidly affixed to both of the first section 13 and second section 14 thereof. A second ring 16 is also affixed to the bracket 12 and is adapted for use in holding a washcloth in a rolled configuration. The second ring 16 is affixed to the first section 13 as well as to a portion of the first ring 15. In this way, the bracket 12, first ring 15, and second ring 16 are securely attached to one another so that the holding device 11 is stable and durable. The first and second rings 15, 16 are shown as being composed of a rolled sheet or panel, however in alternate embodiments the first and second rings 15, 16 are alternately composed of wire or other tubular material. Further, the first and second rings 15, 16 are affixed to the bracket 12 and to one another using any suitable fastening method, such as by means of welding or adhesives, among others.

The first ring 15 is preferably larger in diameter than said second ring 16 so that said first ring 15 defines a larger central area 18 than the central area 19 defined by the second ring 16. In this way, the first ring 15 is suited for holding a towel, whereas the second ring 16 is suited for holding a washcloth. In alternate embodiments, the second ring 16 is larger in diameter than the first ring 15.

Figure 3:
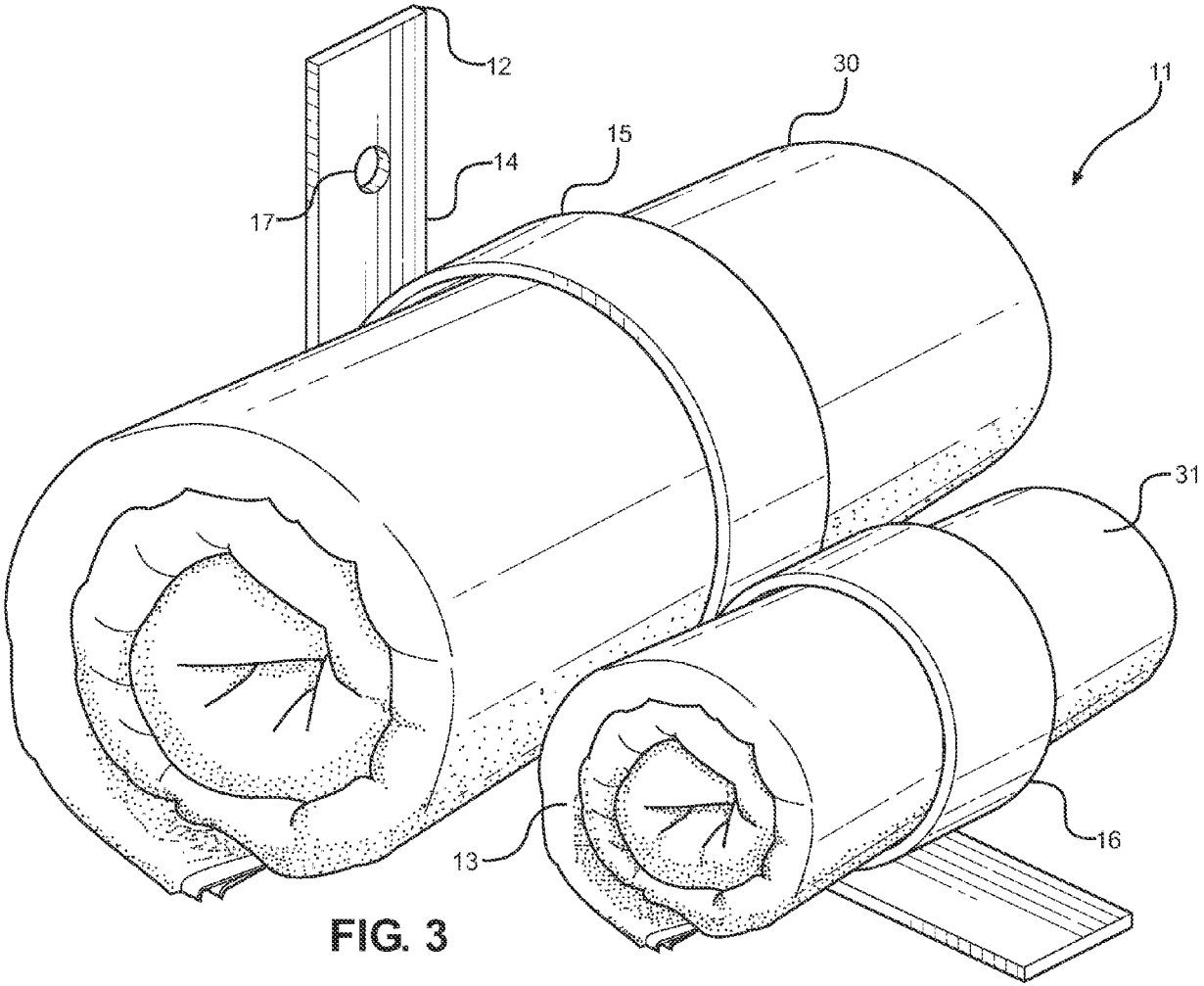
FIG. 3 shows a perspective view of an embodiment of the holding device in use.

Referring now to FIG. 3, there is shown a perspective view of an embodiment of the holding device in use. In operation, the bracket 12 can be mounted to a support surface, such as a wall, by inserting fasteners through the apertures 17 thereon. The user can then position a rolled towel into the open central area of the first ring 15, wherein the ring 15 holds the towel in position. The user can further insert a washcloth into the open central area of the second ring 16. The towel and washcloth are held adjacent to one another for easy access thereto. In this way, a washcloth and towel are stored together in a compact configuration.

Figure 4:
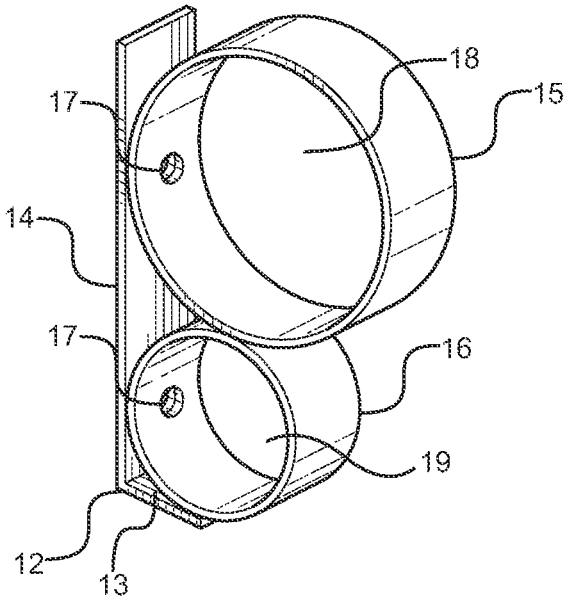
FIG. 4 shows a perspective view of an alternate embodiment of the holding device.
Figure 5:
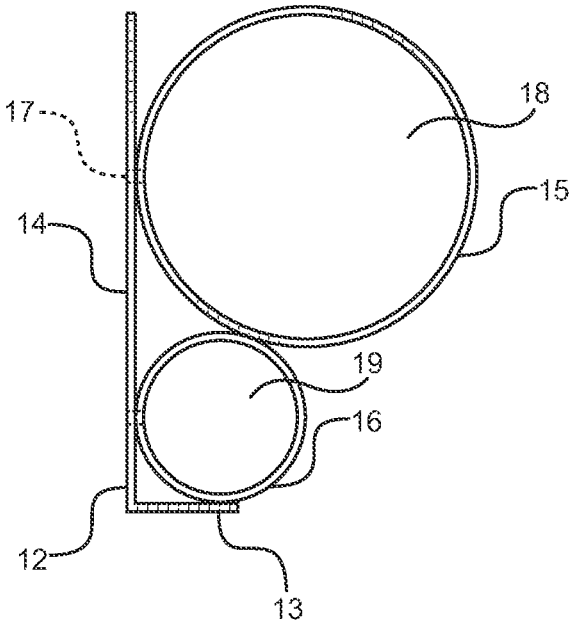
FIG. 5 shows a side view of an alternate embodiment of the holding device.

Referring now to FIGS. 4 and 5, there are shown perspective and side views of an alternate embodiment of the holding device of the present invention. The illustrated embodiment provides a holding device 11 wherein the first and second rings 15, 16 are arranged in alternate positions. The illustrated embodiment comprises a bracket 12 having a first section 13 and a second section 14. Preferably, the first and second sections 13, 14 are perpendicular to one another. A second ring 16 is affixed to the bracket 12 and contacts both the first and second section 13, 14 thereof. A first ring 15 is positioned on the second section 14 of the bracket 12 and contacts the second ring 16. Thus, in the illustrated embodiment, the first and second rings 15, 16 are disposed in a vertical, stacked orientation. In this way, a towel can be stored in a rolled configuration within the open central area 18 of the first ring 15 of the holding device 11, and a washcloth can be stored within the open central area 18 of the second ring 16. The washcloth is positioned beneath the towel when stored on the holding device 11.

The bracket 12 comprises one or more apertures 17 thereon through which one or more fasteners can be positioned so as to affix the holding device 11 to a support surface, such as a wall. In the illustrated embodiment, the apertures 17 are positioned on the second section 14 of the bracket 12 so that the second section 14 can be positioned flush against a support surface and affixed thereto.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A holding device for towels and washcloths, comprising:

a generally L-shaped bracket including a first planar section and a second planar section, the first planar section extending vertically and the second planar section extending horizontally, such that the first planar section and the second planar section are perpendicular relative to one another;

a first ring including an open central area configured to receive a towel or washcloth there through, the first ring fixedly attached directly to the first planar section and fixedly attached directly to the second planar section: a second ring including an open central area configured to receive a towel or washcloth there through, the second ring fixedly attached directly to the first ring and fixedly attached directly to the second planar section: wherein the first ring and the second ring are linearly aligned along a longitudinal axis of the second planar section, such that a center of the first ring is aligned with a center of the second ring relative to the longitudinal axis;

wherein the first ring includes a larger diameter than a diameter of the second ring; and wherein the bracket includes a first aperture disposed on an end of first section and a second aperture disposed along a length of the first section;

wherein the first ring includes a third aperture aligned with the second aperture of the bracket so that a fastener is configured to extend through the third aperture into the second aperture in order to mount the holding device to a wall.

2. The holding device for towels and washcloths of claim 1, wherein a length of the first planar section is equal to a length of the second planar section.

3. A holding device for towels and washcloths, comprising:

a generally L-shaped bracket including a first planar section and a second planar section, the first planar section extending vertically and the second planar section extending horizontally, such that the first planar section and the second planar section are perpendicular relative to one another;

a first ring including an open central area configured to receive a towel or washcloth there through, the first ring fixedly attached directly to the first planar section and fixedly attached directly to the second planar section; a second ring including an open central area configured to receive a towel or washcloth there through, the second ring fixedly attached directly to the first ring and fixedly attached directly to the first planar section; wherein the first ring and the second ring are linearly aligned along a longitudinal axis of the first planar section, such that a center of the first ring is aligned with a center of the second ring relative to the longitudinal axis; wherein the first ring includes a smaller diameter than a diameter of the second ring;

wherein the bracket includes a first aperture disposed on an end of first section and a second aperture disposed along a length of the first section;

wherein the first ring includes a third aperture aligned with the second aperture of the bracket so that a fastener is configured to extend through the third aperture into the second aperture in order to mount the holding device to a wall.

4. The holding device for towels and washcloths of claim 3, wherein a length of the first planar section is greater than a length of the second planar section.

* * * * *